US008413594B2

(12) United States Patent
Ensley

(10) Patent No.: US 8,413,594 B2
(45) Date of Patent: Apr. 9, 2013

(54) FOLDING LEG LATCH ASSEMBLY

(75) Inventor: Michael John Ensley, Lehigh Acres, FL (US)

(73) Assignee: DSA International, Inc., Zeeland, MI (US)

( * ) Notice: Subject to any disclaimer, the term of this patent is extended or adjusted under 35 U.S.C. 154(b) by 161 days.

(21) Appl. No.: 12/917,665

(22) Filed: Nov. 2, 2010

(65) Prior Publication Data

US 2012/0042809 A1 Feb. 23, 2012

Related U.S. Application Data

(60) Provisional application No. 61/374,787, filed on Aug. 18, 2010.

(51) Int. Cl.
*A47B 3/00* (2006.01)

(52) U.S. Cl.
USPC ..... 108/132; 108/133

(58) Field of Classification Search ..... 108/115, 108/133, 132, 131, 129, 125, 127, 128, 126, 108/130; 248/188.6
See application file for complete search history.

(56) References Cited

U.S. PATENT DOCUMENTS

| | | | | |
|---|---|---|---|---|
| 120,550 | A | 10/1871 | Thornton | 108/6 |
| 963,439 | A | 7/1910 | Hastings | 108/132 |
| 1,203,783 | A | 11/1916 | Reischmann | 108/132 |
| 1,752,304 | A | 4/1930 | Kovats | 108/126 |
| 2,121,398 | A | 6/1938 | Dukes | 108/79 |
| 2,823,087 | A | 2/1958 | Zimmer | 108/18 |
| 2,978,895 | A | 4/1961 | Heisler | 70/57 |
| 3,166,029 | A | 1/1965 | Acton | 108/124 |
| 3,199,825 | A | 8/1965 | Bellows | 248/397 |
| 3,349,728 | A | 10/1967 | Barecki | 108/131 |
| 3,554,141 | A | 1/1971 | Burr | 108/132 |
| 3,641,946 | A | 2/1972 | Channay | 108/6 |
| 3,698,327 | A * | 10/1972 | Litvinoff et al. | 108/2 |
| 3,796,169 | A | 3/1974 | Bales | 108/116 |
| 3,861,329 | A * | 1/1975 | Kitchen, Sr. | 108/125 |
| 3,993,004 | A | 11/1976 | Alme | 108/124 |
| 4,643,105 | A | 2/1987 | Baum | 108/150 |
| 4,773,337 | A | 9/1988 | Ball | 108/124 |
| 4,838,181 | A * | 6/1989 | Luyk | 108/156 |
| 4,986,195 | A | 1/1991 | Diffrient | 108/150 |
| 5,121,697 | A | 6/1992 | Baum | 108/124 |
| 5,174,225 | A | 12/1992 | Reise | 108/150 |
| 5,205,223 | A | 4/1993 | Ball | 108/124 |
| 5,323,713 | A | 6/1994 | Luyk | 108/131 |
| 5,354,027 | A | 10/1994 | Cox | 248/292.14 |
| 5,673,633 | A | 10/1997 | Pfister | 108/132 |
| 5,845,589 | A * | 12/1998 | Pfister | 108/132 |

(Continued)

FOREIGN PATENT DOCUMENTS

JP 10-179261 7/1998

*Primary Examiner* — Jose V Chen
*Assistant Examiner* — Matthew Ing
(74) *Attorney, Agent, or Firm* — Dowell IP, P.C.

(57) ABSTRACT

Presented is an improved latching mechanism for table legs. While maintaining the benefits of standard folding mechanisms, the mechanism also achieves many benefits including improved table rigidity, an intuitively operable release mechanism, an easily constructed mechanism with as little as three molded pieces and a spring, a single release action to release the mechanism from both a "use" and "folded" configuration, and four spatially separated latching points for each of the "use" and "folded" configurations. Additionally the mechanism meets or exceeds government and industry standards while having a refined appearance.

20 Claims, 18 Drawing Sheets

U.S. PATENT DOCUMENTS

| | | | | |
|---|---|---|---|---|
| 6,006,880 | A | 12/1999 | Daniel | 192/3.57 |
| 6,336,414 | B1 | 1/2002 | Stewart | 108/50.02 |
| 6,386,119 | B1 | 5/2002 | Lin | 108/133 |
| 6,394,005 | B1 | 5/2002 | Isensee | 108/132 |
| 6,637,352 | B1 | 10/2003 | Thode | 108/132 |
| 6,845,723 | B2 | 1/2005 | Kottman | 108/132 |
| 7,007,587 | B2 | 3/2006 | Zanden | 91/437 |
| 7,350,469 | B2 | 4/2008 | Koning | 108/132 |
| 2003/0167980 | A1* | 9/2003 | Suzuki | 108/129 |
| 2007/0137534 | A1* | 6/2007 | Dhanoa et al. | 108/115 |
| 2008/0178778 | A1* | 7/2008 | Koning et al. | 108/132 |
| 2010/0071600 | A1* | 3/2010 | Lin | 108/115 |

* cited by examiner

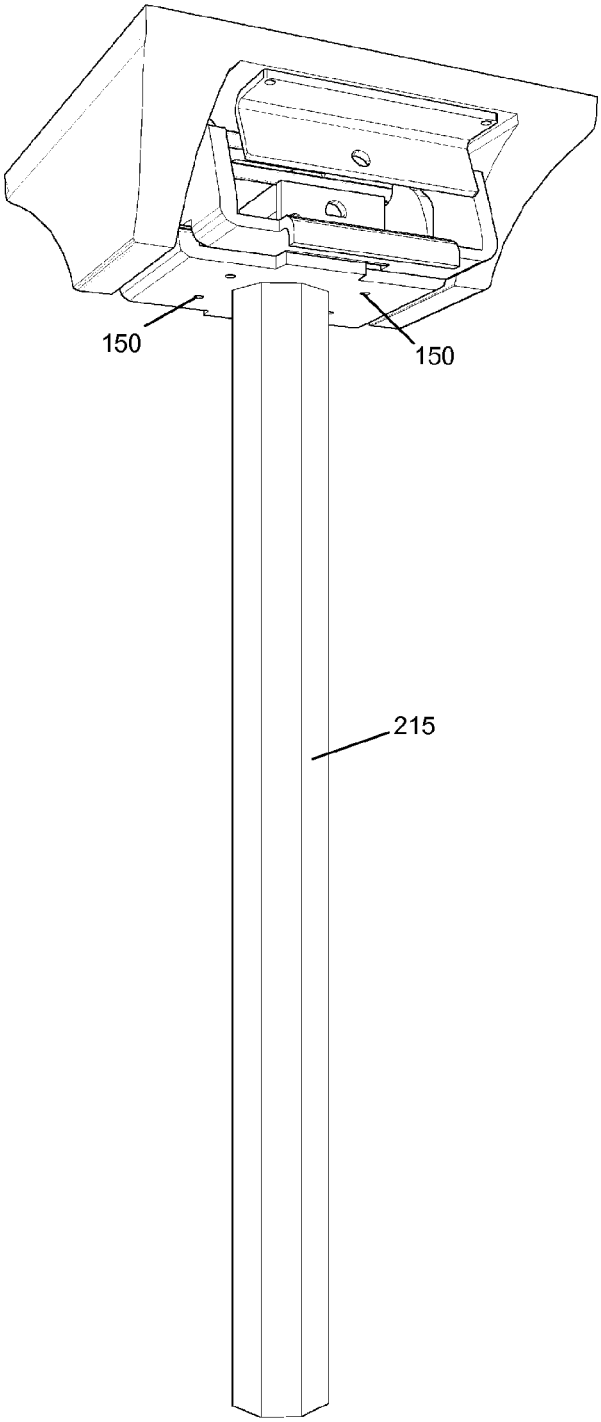
FIG. 27
FIG. 28
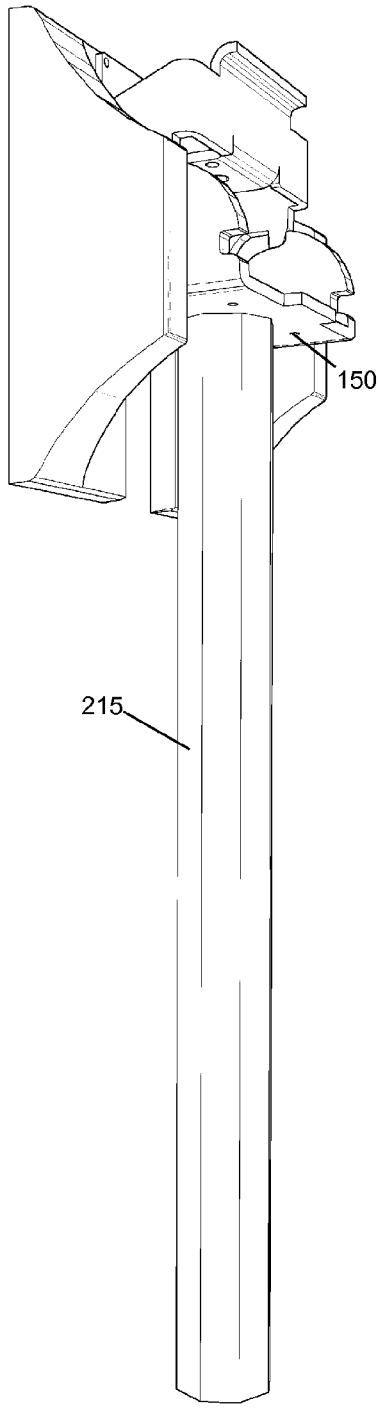

FIG. 32
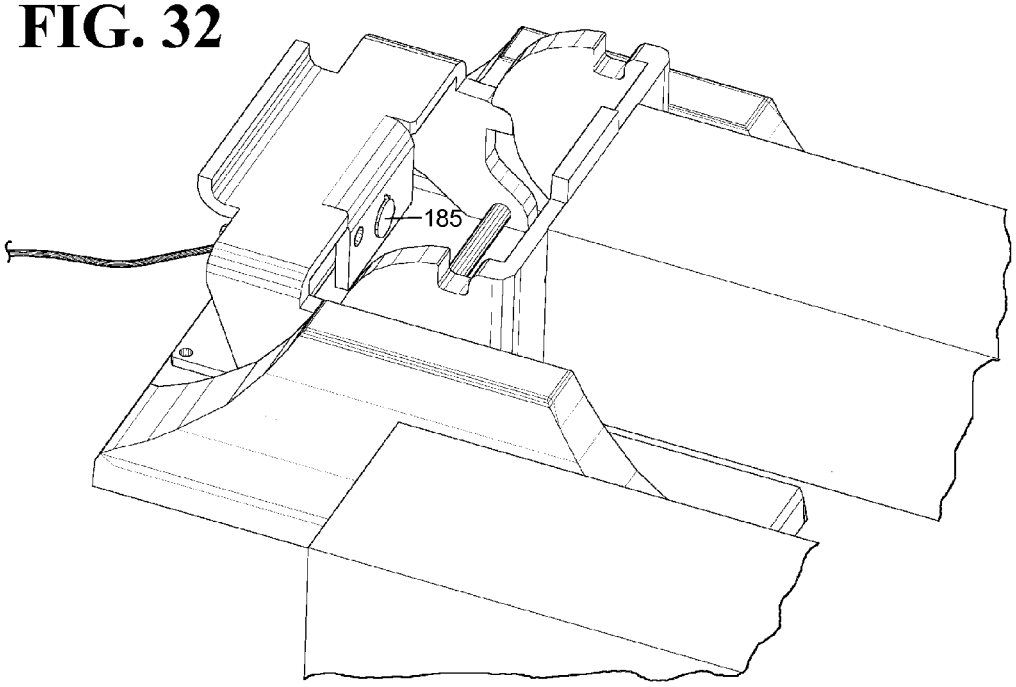
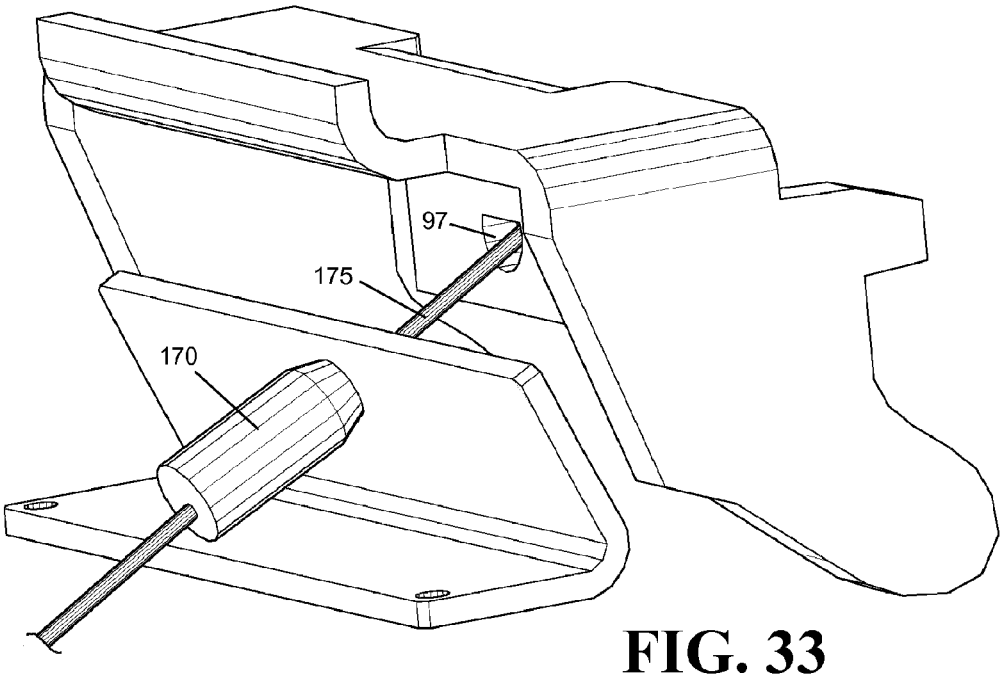
FIG. 33

FOLDING LEG LATCH ASSEMBLY

CROSS-REFERENCE TO COPENDING APPLICATIONS

This application claims the benefit of U.S. Provisional Patent Application 61/374,787 entitled "Flip and Fold Mechanism" filed Aug. 18, 2010 by Michael John Ensley, the contents of which are herein incorporated by reference;

FIELD OF THE INVENTION

The present invention relates generally to a latching mechanism, and more particularly to a latching mechanism for a table leg latch assembly having improved stability, robustness, and ease of manufacture.

BACKGROUND OF THE INVENTION

Folding tables are commonly used in commercial and residential settings where tables are intermittently needed, or the tables need to be moved on a regular basis. Tables in a storage configuration take up less space and are often stackable on other folded tables, thus reducing the amount of storage space needed. Latching mechanisms have been used to lock the table legs in either a storage or use configuration, however these mechanisms often do not provide sufficient rigidity and may cause the table to wobble. Additionally, latching mechanisms often involve numerous small interconnected pieces that may jam due to the buildup of dirt and debris, or be damaged when the tables are transported or stored.

SUMMARY OF THE INVENTION

The present invention provides an improved latching mechanism for tables with foldable legs. While maintaining the benefits of standard mechanisms, the mechanism of the present invention also achieves many benefits including an intuitively operable release mechanism, a single release action for both the "use" and "storage" configurations, improved table rigidity with two spatially separated latching points in both the "use" and "storage" configurations, a robust design that requires as little as three separate manufactured pieces. Additionally the present invention provides a mechanism that meets or exceeds government and industry standards and has a refined appearance.

BRIEF DESCRIPTION OF THE DRAWINGS

FIG. 27 is a perspective view of the table leg folding mechanism of FIG. 1 in a use configuration secured to a table leg.

FIG. 28 is a perspective view of the table leg folding mechanism of FIG. 1 in a storage configuration secured to a table leg.

FIG. 32 is a top perspective view of a leg folding mechanism that includes a cable release device.

FIG. 33 is a top perspective view of a leg folding mechanism that includes a cable release device, wherein the mechanism is shown without the base and rotor for illustrative purposes.

DETAILED DESCRIPTION

The present invention may be used with any type of leg and any type of top surface and is particularly suited for tables and applications requiring a lightweight, rigid, and robust mechanism with an intuitively operated release action. The improved folding mechanism may be used with objects with folding legs such as chairs and tables, stadium seating or benches. However, for descriptive purposes, the present invention will be described in use with a table.

Figure 1:
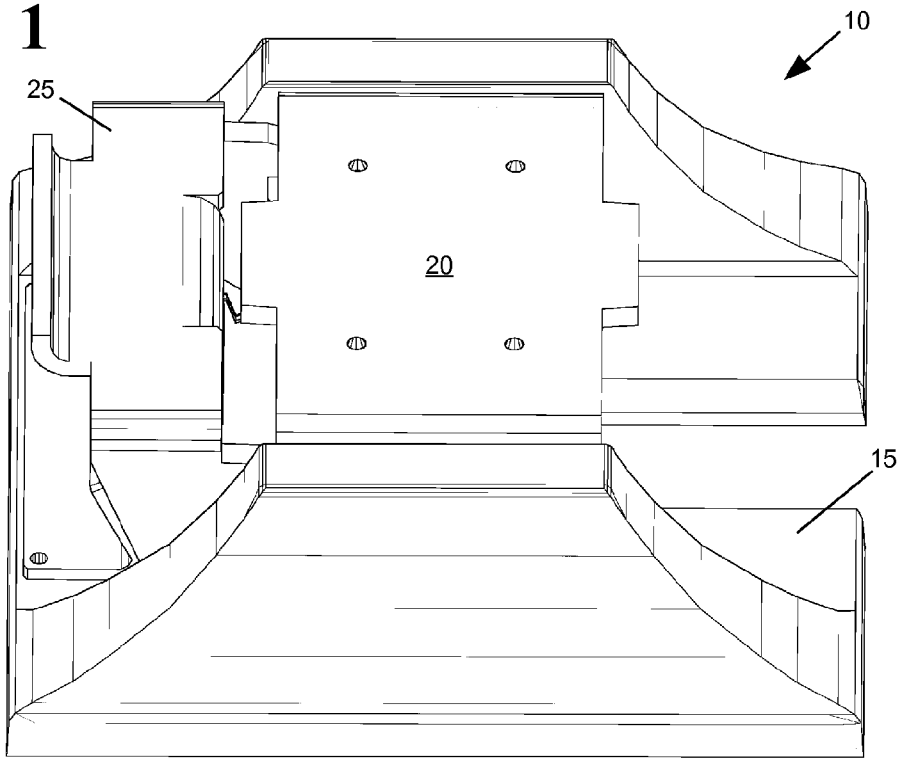
FIG. 1 is a side perspective view of a table leg folding mechanism in a use configuration.
Figure 2:
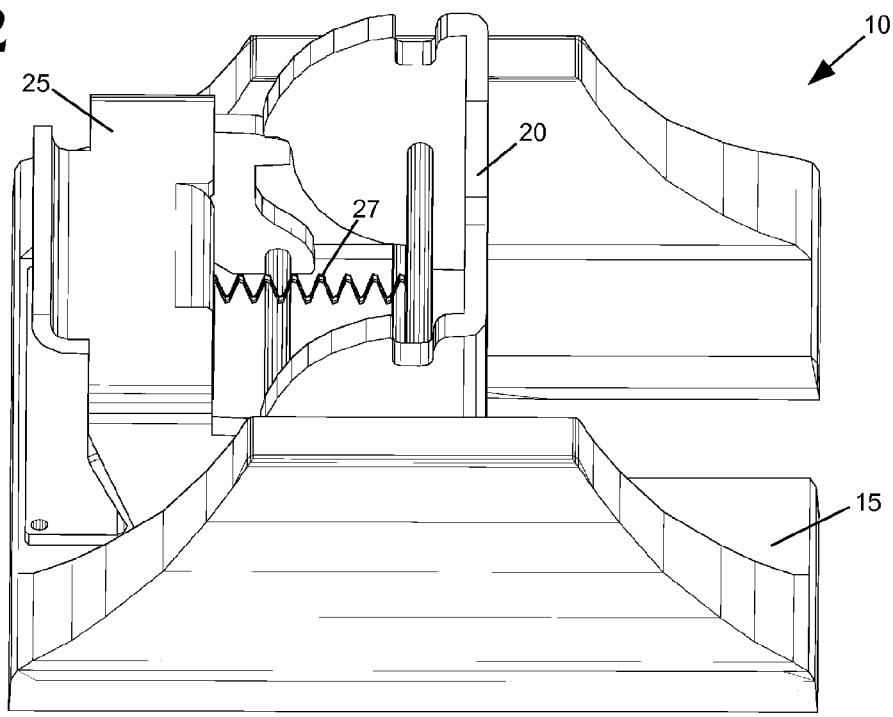
FIG. 2 is a side perspective view of the table leg folding mechanism of FIG. 1 in a storage configuration.

FIGS. 1-2 show views of a folding mechanism 10 having a base 15, a rotor 20 adapted to be secured to a table leg, and a latch 25. The rotor 20 and the latch 25 are both rotatably secured to the base at unique locations such that the rotor 20 and the latch 25 have unique axes of rotation. FIG. 1 illustrates the folding mechanism in a use configuration and FIG. 2 illustrates the folding mechanism in a storage configuration. The rotor 20 and the table leg are rotated approximately 90 degrees relative to the base between the storage and use configurations. In both the use and storage configurations, the latch and portions of the base hold the rotor and table leg in the use or storage configuration. The latch may be selectively withdrawn from the rotor to enable the rotor to transition from the use or storage configurations.

A spring 27 forces the latch 25 towards the rotor 20 to prevent the latch from accidentally disengaging from the rotor. In addition to helping keep the rotor in the storage or use configurations, when the rotor is transitioned from the storage configuration to the use configuration (or from the use configuration to the storage configuration) the springs acts to automatically interlock the latch with the rotor once the rotor has been rotated to one of the orientations. Although a tension spring extending between the latch and rod is show in the illustrated example, various other devices and configurations may be used to force the latch to rotate towards the rotor. For example, a compression spring between the base and the latch may act to rotate the latch. Alternatively, a torsion spring may be wrapped around the axis of rotation for the latch such that is presses upon both the base and the latch.

Figure 3:
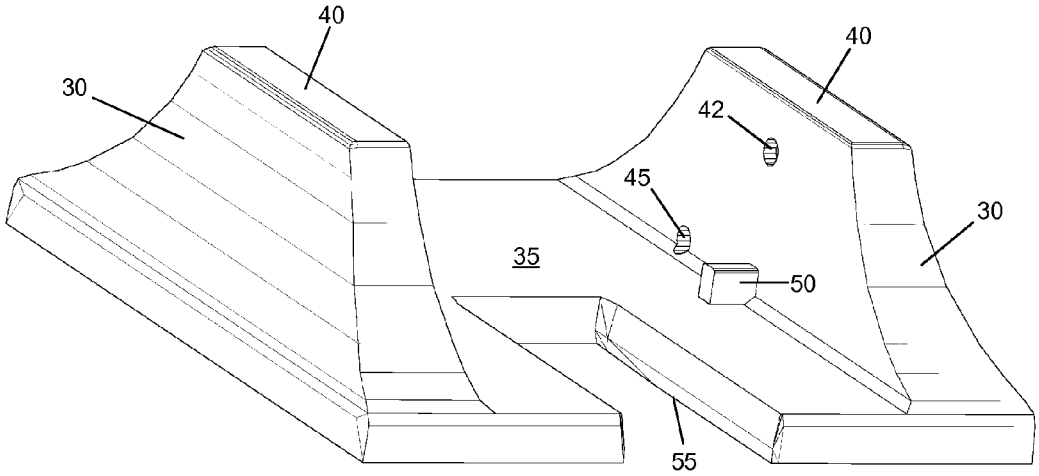
FIG. 3 is a side perspective view of a base for a table leg folding mechanism.
Figure 4:
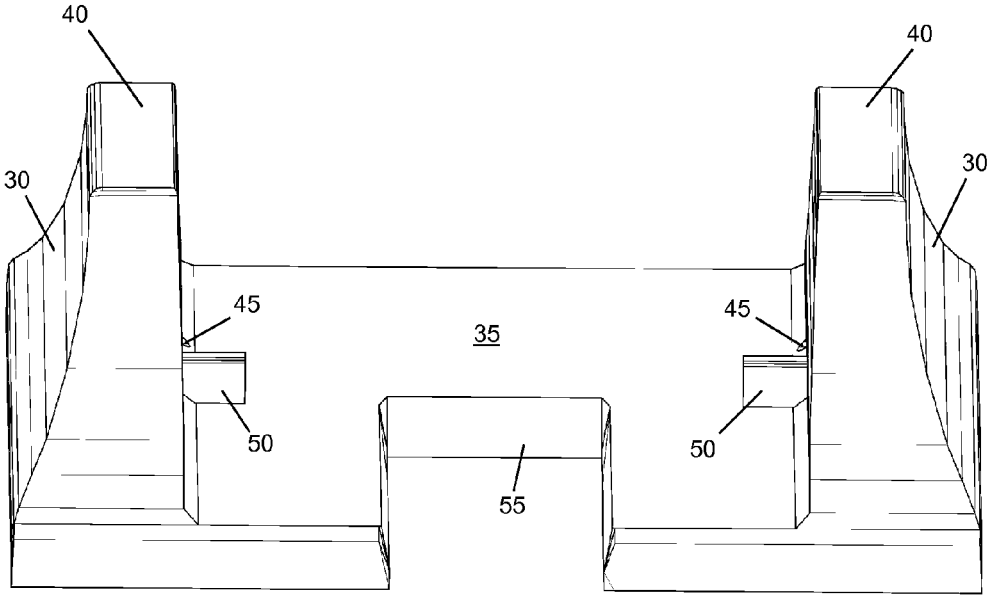
FIG. 4 is a front perspective view of a base for a table leg folding mechanism.

A base, shown isolated in FIGS. 3 and 4 for clarity, is configured to be rigidly secured to a structure, such as a table top, through a fastener such as screws, nails, or an adhesive. The base includes two walls 30 that flank and are rotatably secured to the rotor 20 and parts of the latch 25. The walls 30 extend from an expanded table mount 35 and taper towards a leg end 40 of the wall. The expanded area of the table mount provides a large contact surface between the latching mechanism and the tabletop that helps to improve the stability of the table. In one embodiment, the table mount portion 35 of the base includes a plurality of apertures through which screws or nails are passed through to secure the base to a tabletop.

In the illustrated example, walls 30 are tapered down to a width that is substantially similar to the width of the rotor. Additionally, the taper of the walls provides a smoothed surface and reduces the number of sharp edges and snag points on the latching mechanism. In the embodiment of the base shown in FIGS. 3 and 4, the walls include a first set of holes 42 adapted to rotatably connect to the rotor and a second set of holes 45 adapted to rotatably connect to the latch. The walls illustrated in FIGS. 3 and 4 also include base protrusions 50 adapted to contact the rotor and prevent rotation of the rotor in both the storage and use configurations. In an alternate embodiment of the base, the wall may include a third set of holes adapted to receive a rod that extends between the two walls and, like the protrusions, acts to prevent rotation of the rotor in both the use and storage configurations.

In the illustrated example of the base, the table mount portion 35 of the base includes an extended groove 55 that extends parallel to the interior sides of the two walls. The extended groove may act to receive a portion of the rotor and provides an additional contact area when the latching mechanism is in a storage configuration. Additionally, the extended groove may be structured to receive a portion of a table leg and thus allow the table leg to be folded closer to the tabletop when the table is in the storage configuration.

The base, the latch, and the rotor may be constructed from a wide variety of materials such as plastics, metals, natural materials, and composite materials. Materials contemplated by the inventor include molded glass, fiberglass, nylon, glass material, metal, cold rolled steel, hot rolled pickled and oiled steel, stamped steel, stamped aluminum, carbon/nylon reinforced textile sheets, amarid, polyester, and carbon fiber. For components created by an injection molding process, the resins contemplated by the inventor include epoxy, unsaturated polyester, urethane acrylate, vinyl ester, phenol, polyurethane, a thermoplastic resin, nylon 6, nylon 66, nylon 12, PBT, PET, polycarbonate, polyacetal, polyphenylene sulfide, polyether ether ketone, polyether sulfide, polyphenylene oxide, modified polyphenylene oxide, polypropylene, polyvinyl chloride, ethylene-vinyl acetate copolymer, polystyrene, acrylonitrile-butadiene-styrene copolymers (ABS), 6, 11, 12, 6-6 and 6-10 polyamides, poly(ether amide) sequenced copolymer, fluorinated polymers, polysulfone, polyethersulfone, polycarbonate, polyetheretherketone, polyphenylene sulfur, polyetherimide, and polyphenylene ether. Coatings such as polytetrafluoroethylene (Telfon®) may be used in the first set of holes 40 and the second set of holes 45 of the base in order to reduce friction when the latching mechanism is transitioned from a use configuration to a storage configuration.

Figure 5:
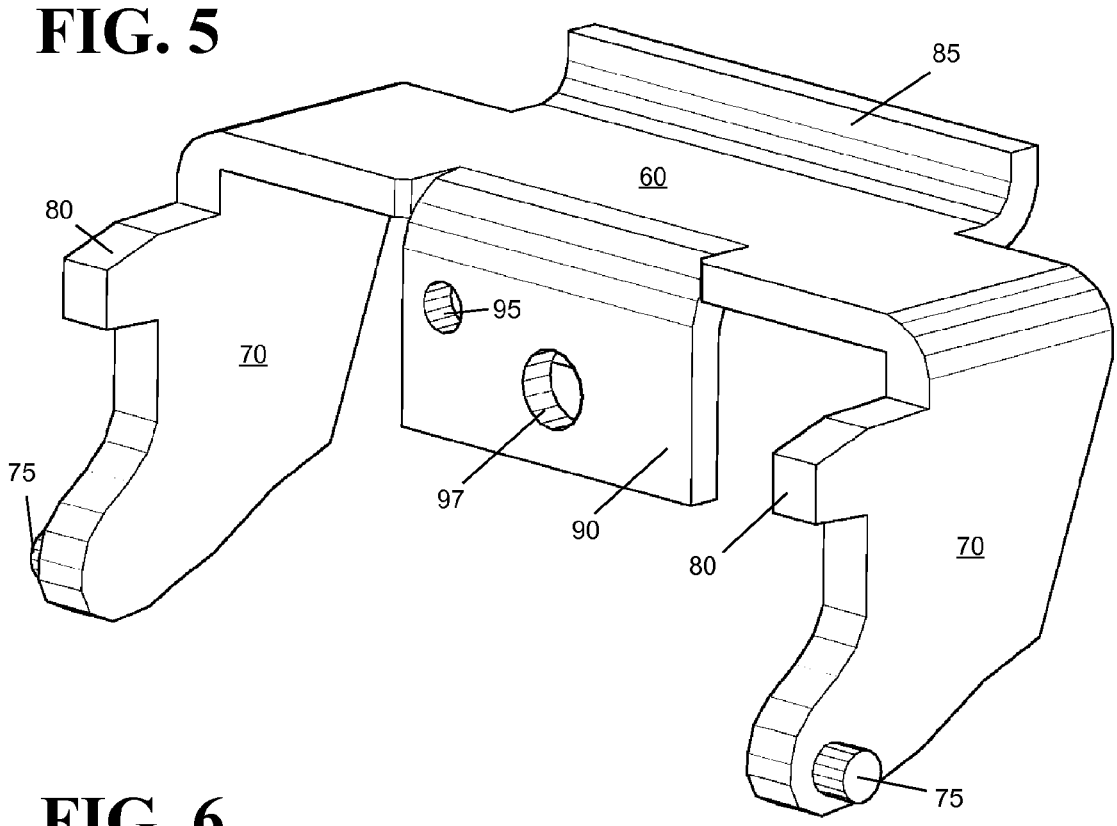
FIG. 5 is a side perspective view of a latch for a table leg folding mechanism.
Figure 6:
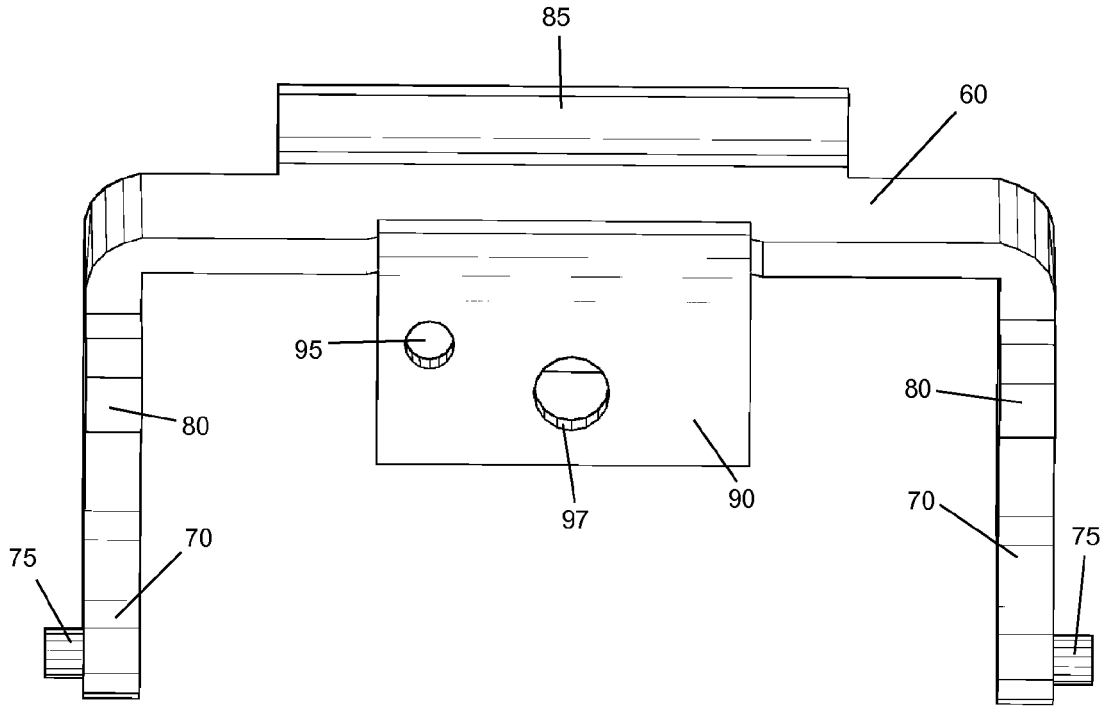
FIG. 6 is a front perspective view of a latch for a table leg folding mechanism.

A latch, shown isolated in FIGS. 5 and 6 for clarity, includes a main section 60 between a first sidewall and second sidewall 70. In the illustrated example, each of the sidewalls includes a sidewall protrusion 75 that is adapted to rotatably connect into the second set of holes in a base of the latching mechanism. Each sidewall 70 also includes a catch 80 configured to interconnect with a rotor. A handle 85 extends from the main section and provides an area for a user to grasp in order to disengage the latch from the rotor. Also extending from the main section 60 of the latch is a torsion section 90 with a spring aperture 95 adapted to be secured to a spring that pushes or pulls the latch towards the rotor. The torsion section 90 also includes a cable release aperture 97 adapted to be secured to a wire release mechanism that allows a user to remotely disengage the latch from the rotor or simultaneously disengage multiple latches from multiple rotors. In the illustrated example of the latch, the handle and intersections of the sidewalls and main section are curved to provide a refined appearance and also to reduce the number of sharp edges on the latching mechanism.

Figure 7:
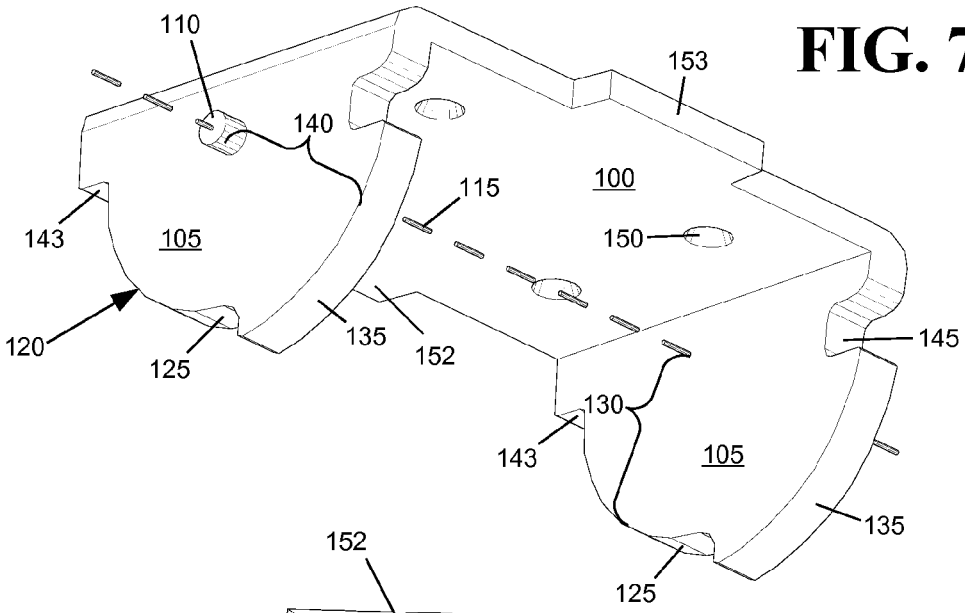
FIG. 7 is a bottom perspective view of a rotor for a table leg folding mechanism.
Figure 8:
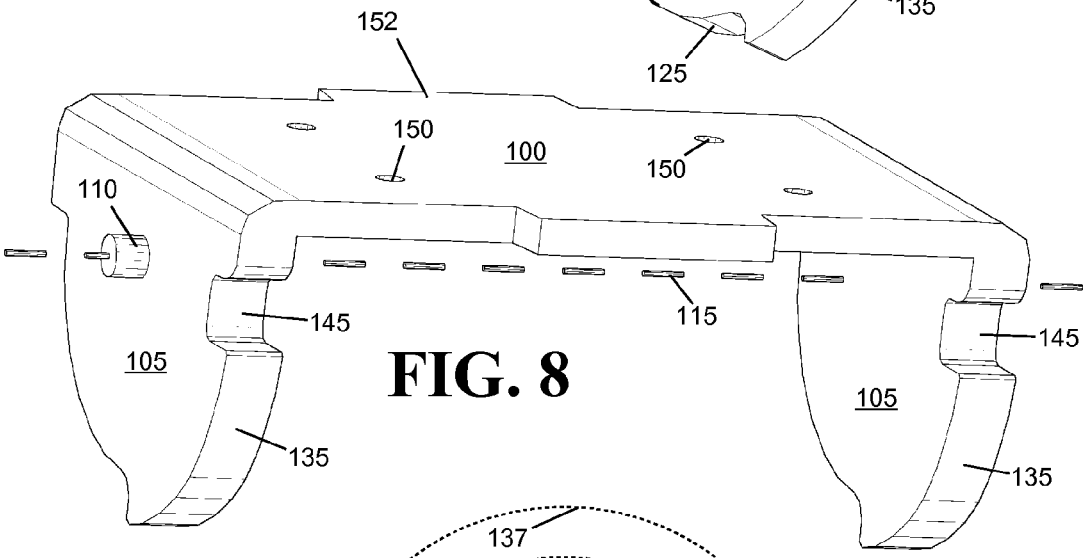
FIG. 8 is a top perspective view of a rotor for a table leg folding mechanism.
Figure 9:
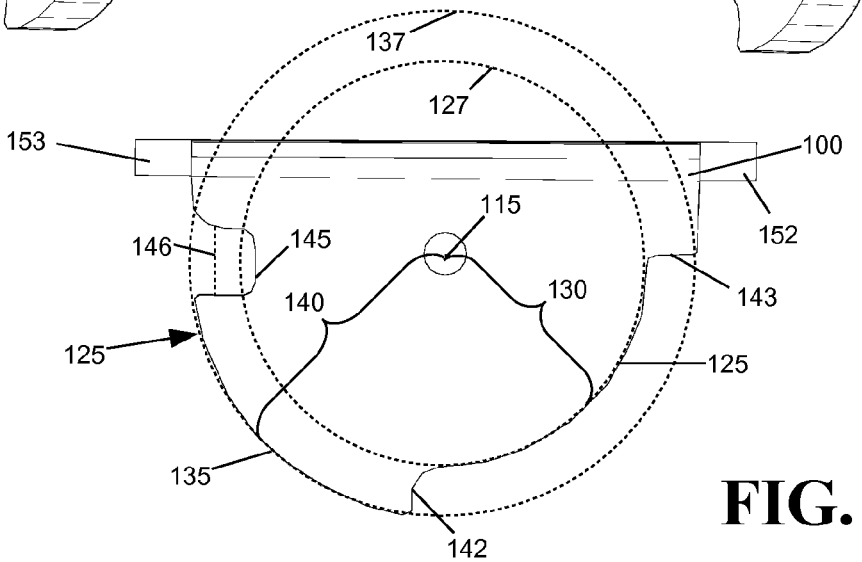
FIG. 9 is a side view of a rotor for a table leg folding mechanism.

A rotor, shown isolated in FIGS. 7-9 for clarity, includes a primary section 100 between two curved end walls 105. Each curved end wall 105 includes an end wall protrusion 110 adapted to be rotatably secured into one of the holes in the first set of holes of the base. The rotor, when secured to the base, is configured to rotate around an axis of rotation 115 extending between the end wall protrusions of the rotor. The primary section 100 and a latching surface 120 cooperate to circumscribe the curved end walls of the rotor. Each of the latching surfaces includes an inner radial surface 125 that is located at substantially an arc of a first right circular cylinder 127 having a central axis at the axis of rotation 115 and a first radius 130. Each of the latching surfaces 120 also includes an outer radial surface 135 located at substantially on an arc of a second right circular cylinder 137 having a central axis at the axis of rotation 115 and a second radius 140. In the illustrate example of a rotor, the arcs of the circular cylinders have central angle of approximately 80 degrees. In other embodiments of rotor, the arcs of the circular cylinders have central angles of at least 30 degrees.

Between the inner radial surface 115 and the outer radial surface 135 on each latching surface 120 is a first protrusion surface 142 adapted to interlock with the protrusion or rod of the base. On the latching surface 120, between the inner radial surface 125 and the primary section 100 is a second protrusion surface 143 adapted to interlock with the protrusion or rod of the base. In the illustrated embodiment, the first protrusion surface 142 and the second protrusion surface 143 are each substantially defined by a plane that includes the axis of rotation 115 such that the intersections of the first protrusion surface and both the inner radial surface and outer radial surface are substantially perpendicular. Each latching surface 120 also includes a notch area 145 with an opening 146 that is distant from both the first and second protrusion surfaces (142 and 143) and located between the outer radial surface 135 and the primary section of the rotor. The notch area is configured to interlock with the catch of a latch. The arc length of the inner radial surface is substantially longer than the height of the catch 80 and the width of the base protrusion such that the catch and base protrusions are not able to individually contact both the first and second protrusion surface 142 and 143 simultaneously.

The primary section of the rotor may include a plurality of leg apertures 150 configured through which fasteners may be used to secure a table leg to the rotor. The rotor may also include a groove protrusion 152 that is configured to interlock with the main groove of the base when the latching mechanism is in a storage configuration, and a latch protrusion 153 that is configure to be adjacent to the latch when the rotor is in the use configuration.

Figure 10:
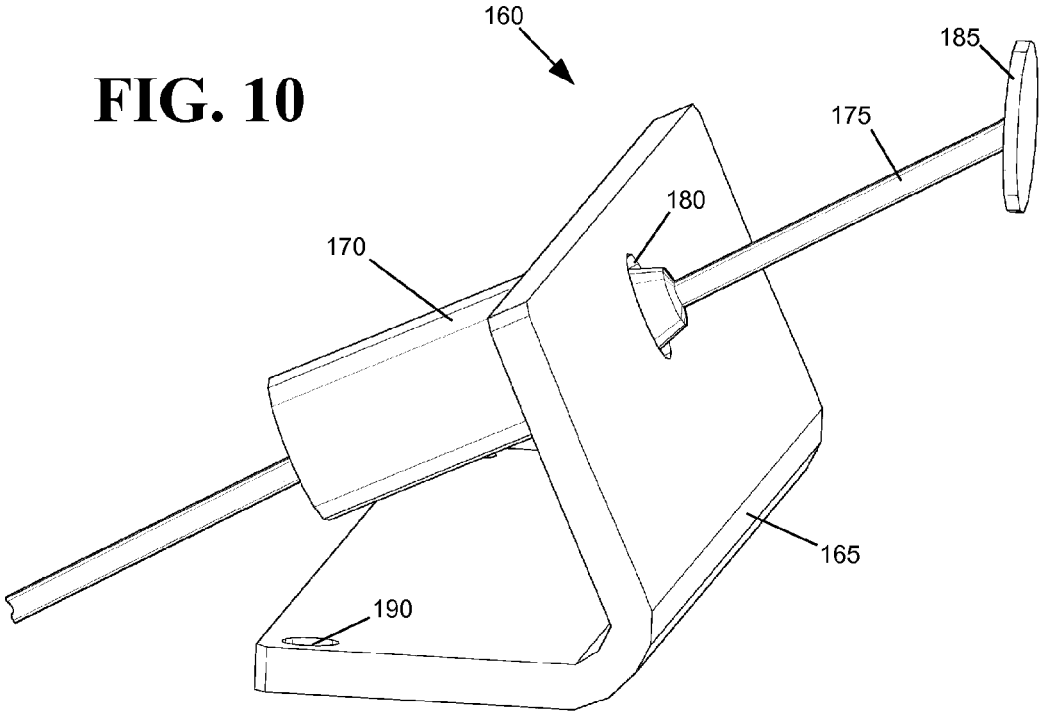
FIG. 10 is a side perspective view of a cable release for a table leg folding mechanism.
Figure 11:
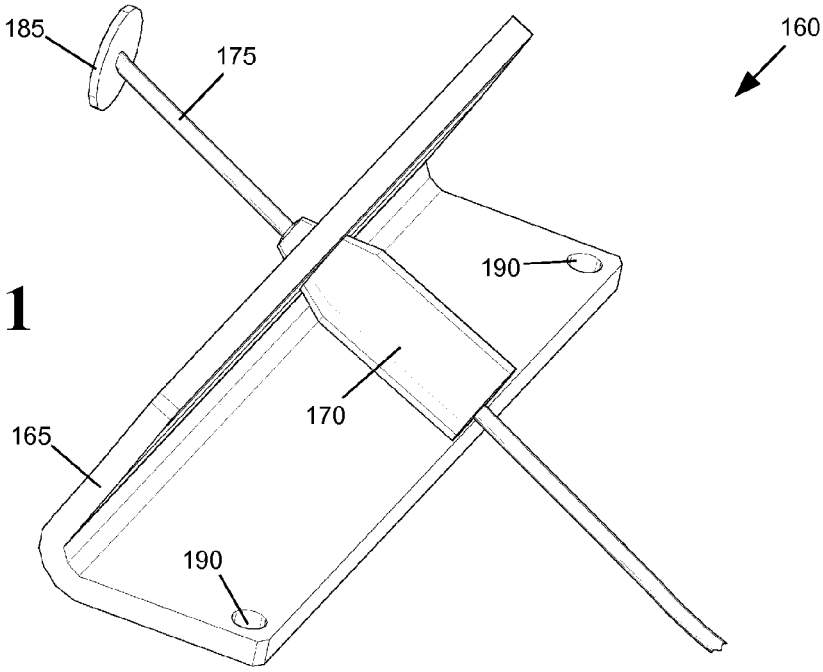
FIG. 11 is a top perspective view of a cable release for a table leg folding mechanism.

A cable mechanism 160, shown isolated in FIGS. 10 and 11 for clarity, having a cable stand 165 holding a cable housing 170 with a cable 175. The cable stand 165 may be secured to the base to enable a user to disengage the latch from the rotor without directly contacting the latch. The cable stand 165 includes a cable aperture 180 through which a portion of the cable housing is secured. The cable aperture is sized to prevent the cable housing from moving towards the latch when the cable is pulled. A washer, disc 185, or other object with a diameter larger than the diameter of the cable release aperture in the latch, may be secured to the end of the cable to pull on the latch when the cable is pulled. Alternatively, the cable may be secured directly to the latch. In the illustrated example, the cable stand includes screw apertures 190 through which fasteners may be threaded to the base of the latching mechanism. However, in other embodiments, the cable stand may be secured to the base using adhesive or another fastener that does not require the use of apertures in the cable stand 165.

Figure 12:
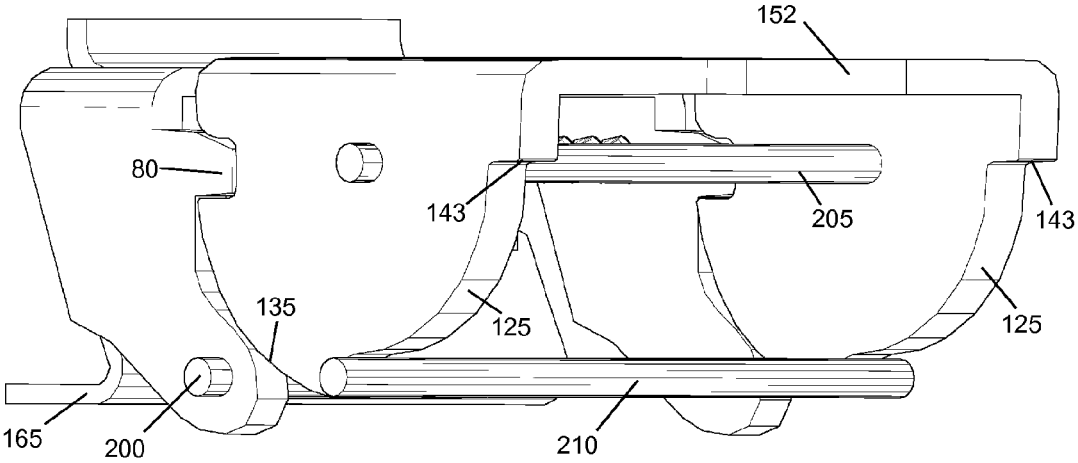
FIG. 12 is a side perspective view of the latch and rotor of the table leg folding mechanism of FIG. 1 in a use configuration.
Figure 13:
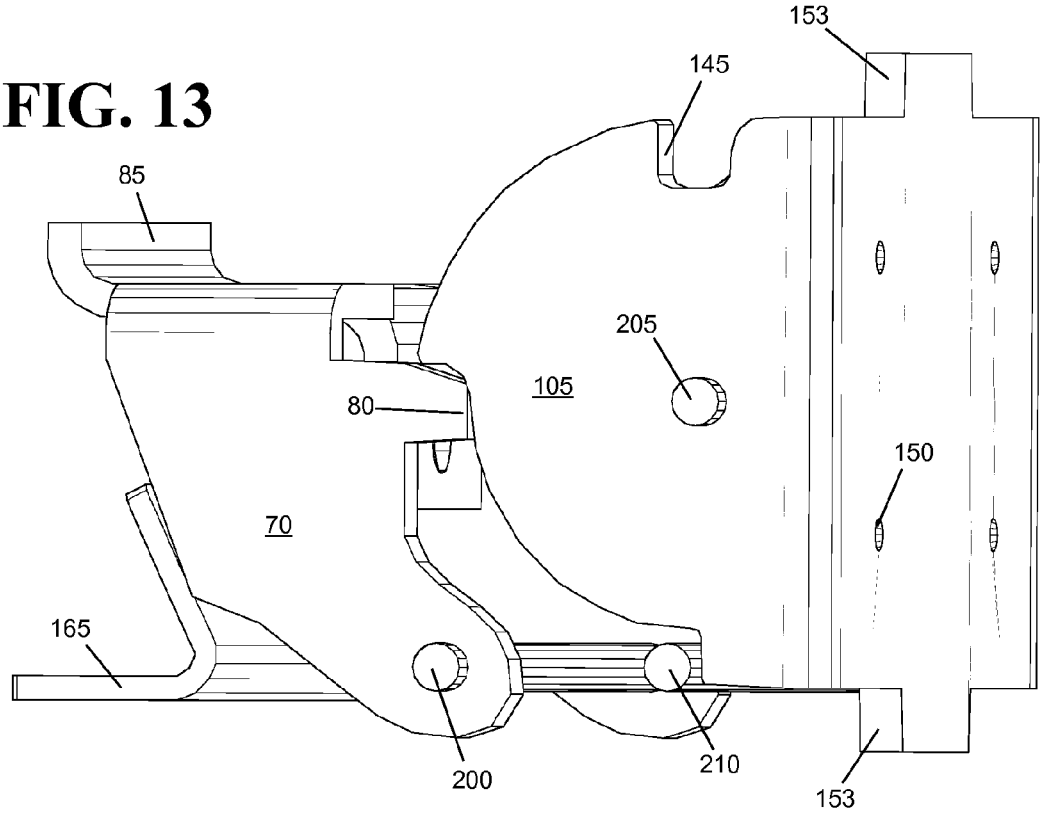
FIG. 13 is a side perspective view of the latch and rotor of the table leg folding mechanism of FIG. 1 in a storage configuration.
Figure 14:
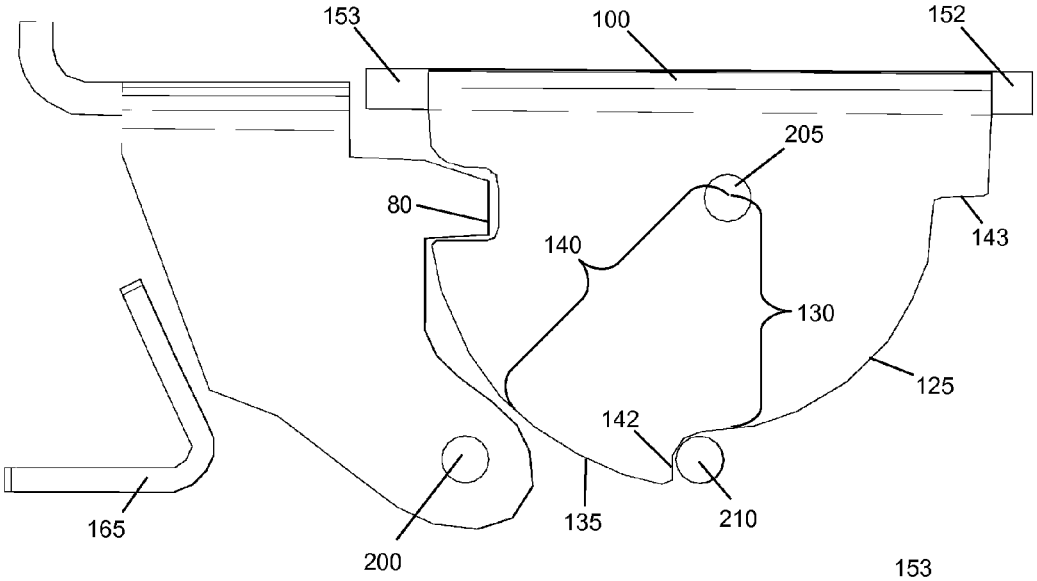
FIG. 14 is a side view of the latch and rotor of the table leg folding mechanism of FIG. 1 in a use configuration.
Figure 15:
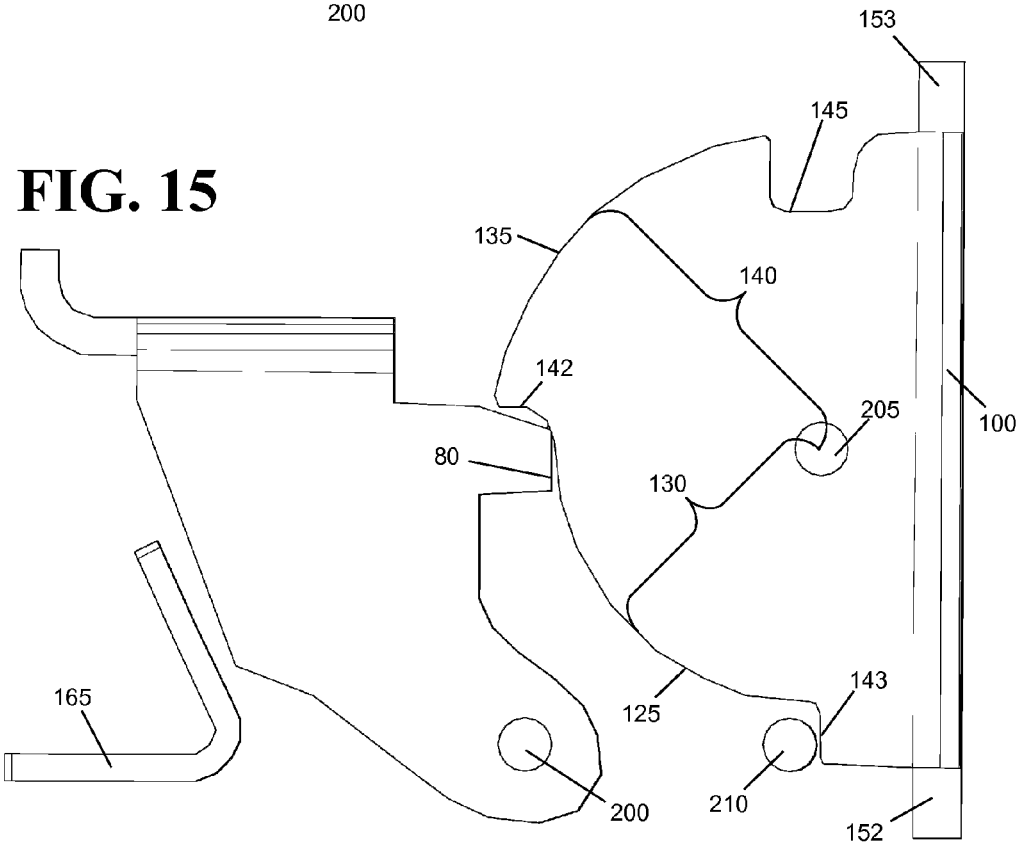
FIG. 15 is a side view of the latch and rotor of the table leg folding mechanism of FIG. 1 in a storage configuration.

In FIGS. 12-15, a cable mechanism, latch and rotor are shown isolated for clarity with a latching rod 200, a rotor rod 205, and a protrusion rod 210 configured to extend between walls of the base. The latch 25 is secured to, and rotates about, the latching rod 200. The rotor 20 is secured to, and rotates about, the rotor rod 205. The protrusion rod 210 is configured to contact either the first or second protrusion surface of the rotor when the latching mechanism is the storage configuration (FIGS. 13 and 15) or use configuration (FIGS. 12 and 14).

Figure 16:
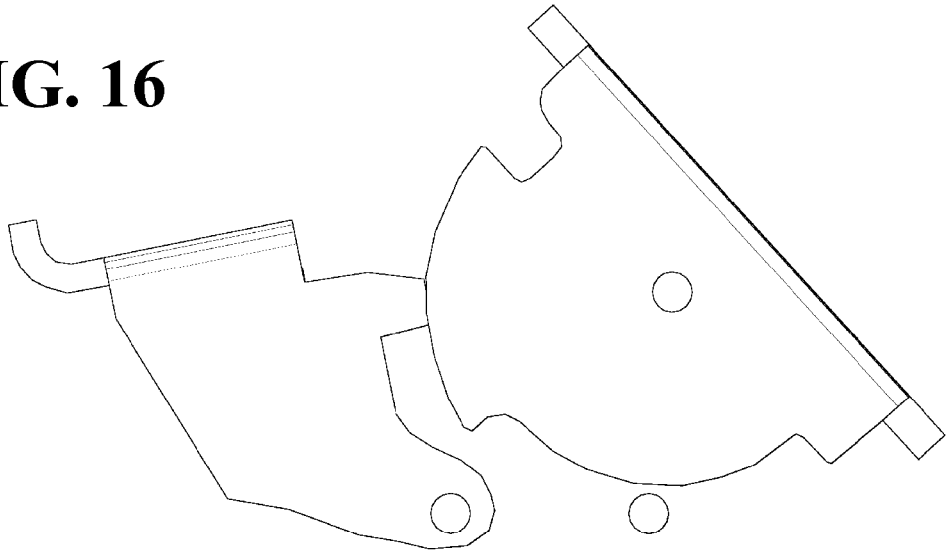
FIG. 16 is a side view of the latch and rotor of the table leg folding mechanism of FIG. 1 in a transitional configuration between a use configuration and a storage configuration.

FIG. 16 illustrates the latch and rotor of FIGS. 12-15 in an intermediate configuration between the use configuration and the storage configuration. The latch has been rotated from the first position shown in FIGS. 12-15 to a second position that allows the rotor to rotate between the storage and use configurations.

Figure 17:
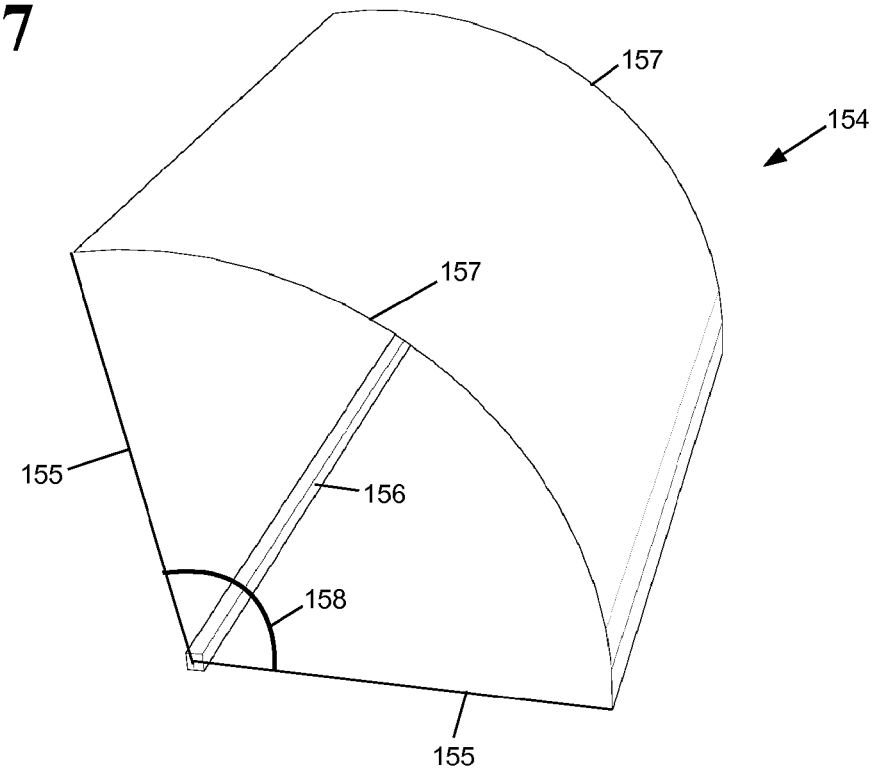
FIG. 17 is a side perspective view of a right circular cylindrical arc.
Figure 18:
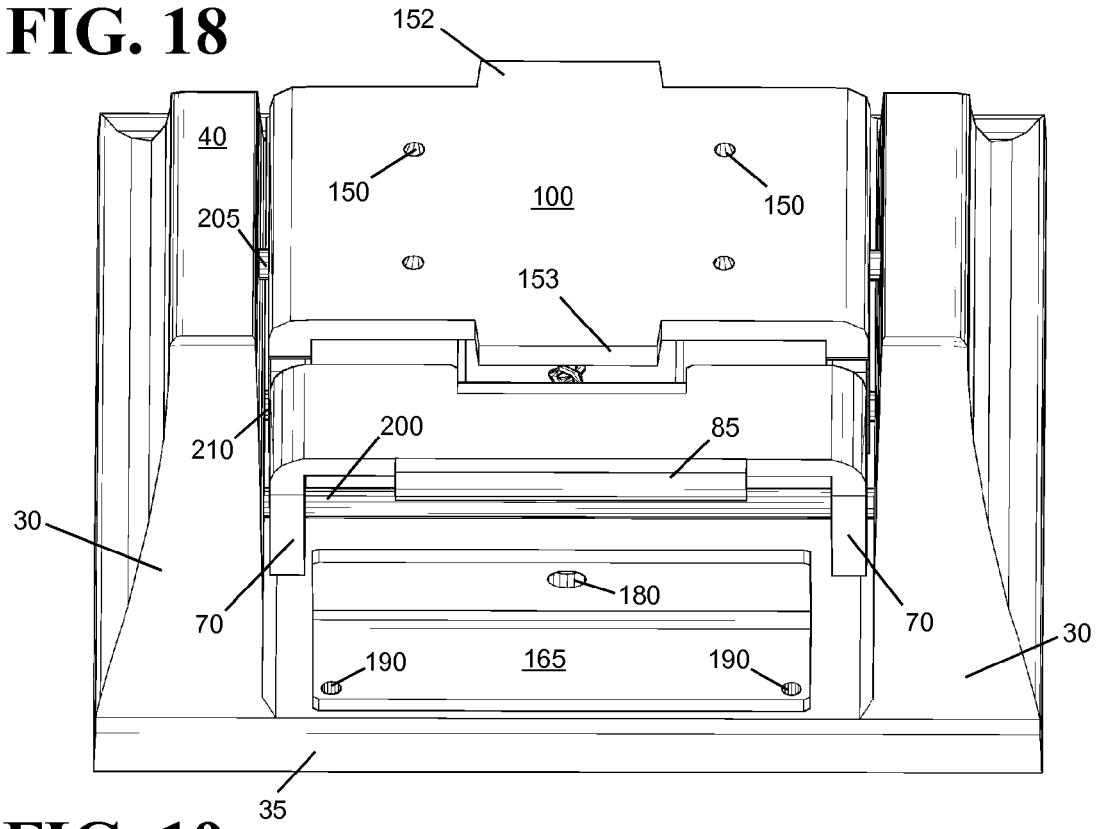
FIG. 18 is a rear perspective view of the table leg folding mechanism of FIG. 1 in a use configuration.
Figure 19:
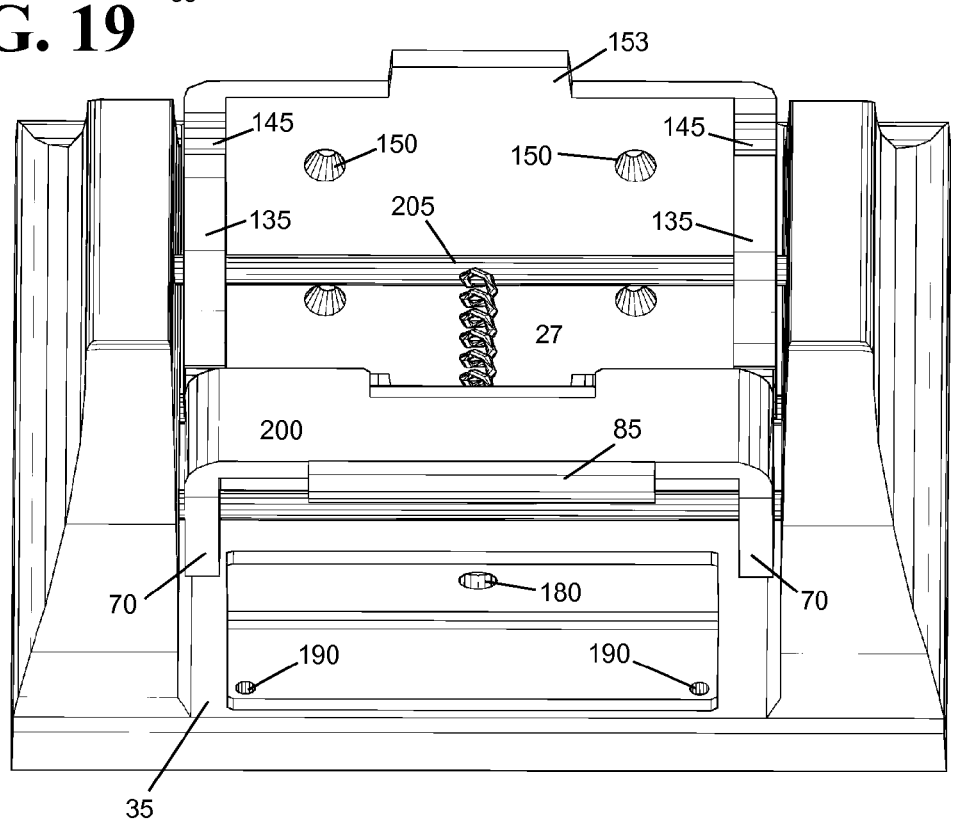
FIG. 19 is a rear perspective view of the table leg folding mechanism of FIG. 1 in a storage configuration.
Figure 20:
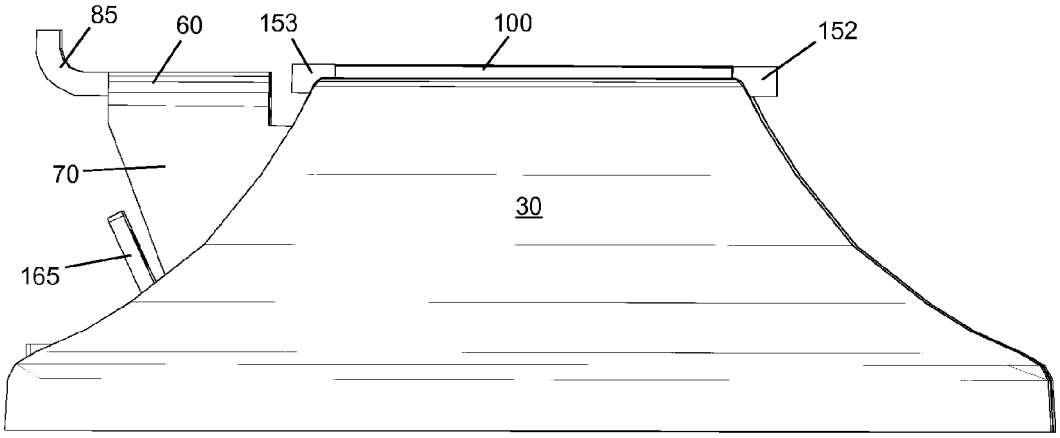
FIG. 20 is a side view of the table leg folding mechanism of FIG. 1 in a use configuration.
Figure 21:
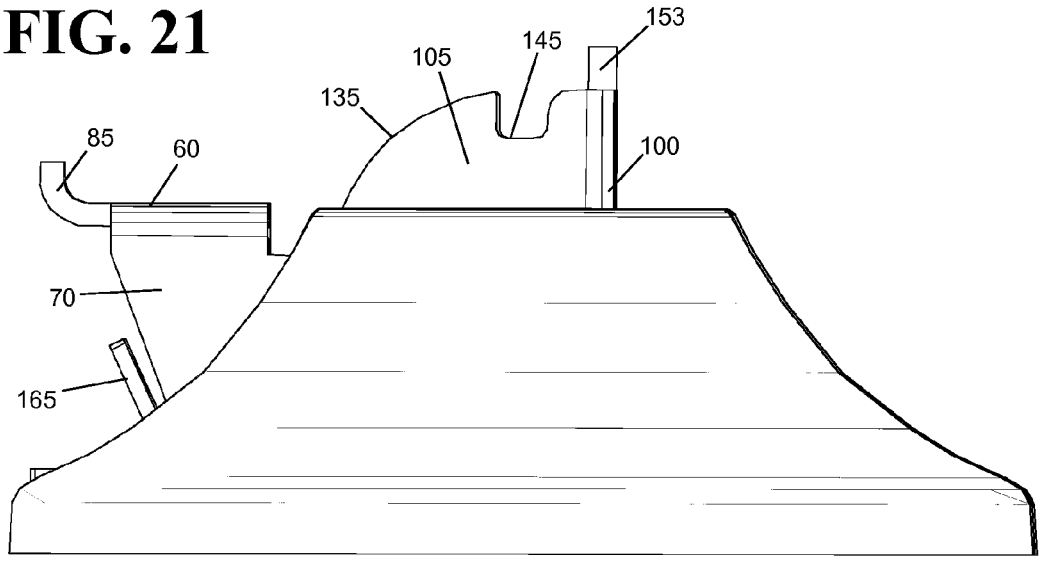
FIG. 21 is a side view of the table leg folding mechanism of FIG. 1 in a storage configuration.
Figure 22:
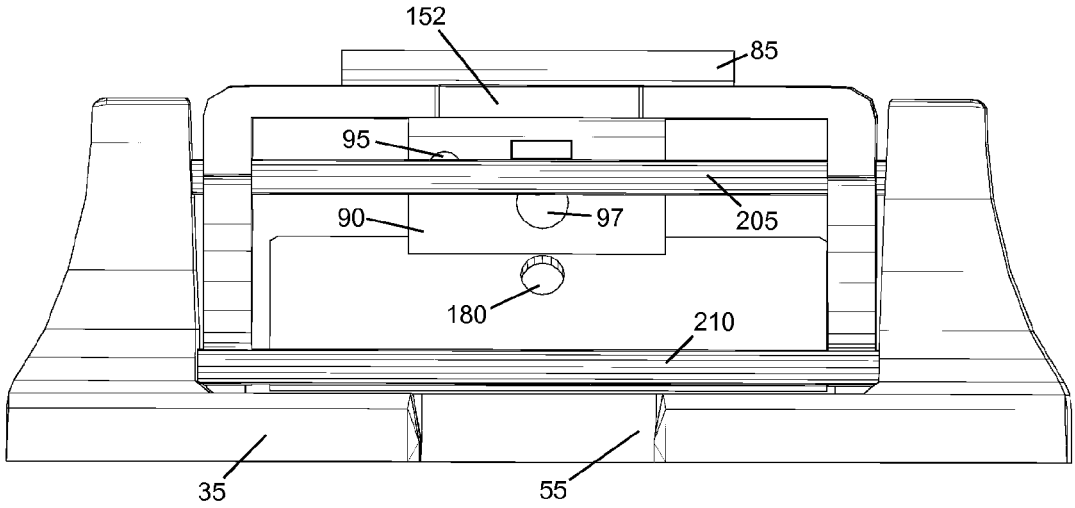
FIG. 22 is a front view of the table leg folding mechanism of FIG. 1 in a use configuration.
Figure 23:
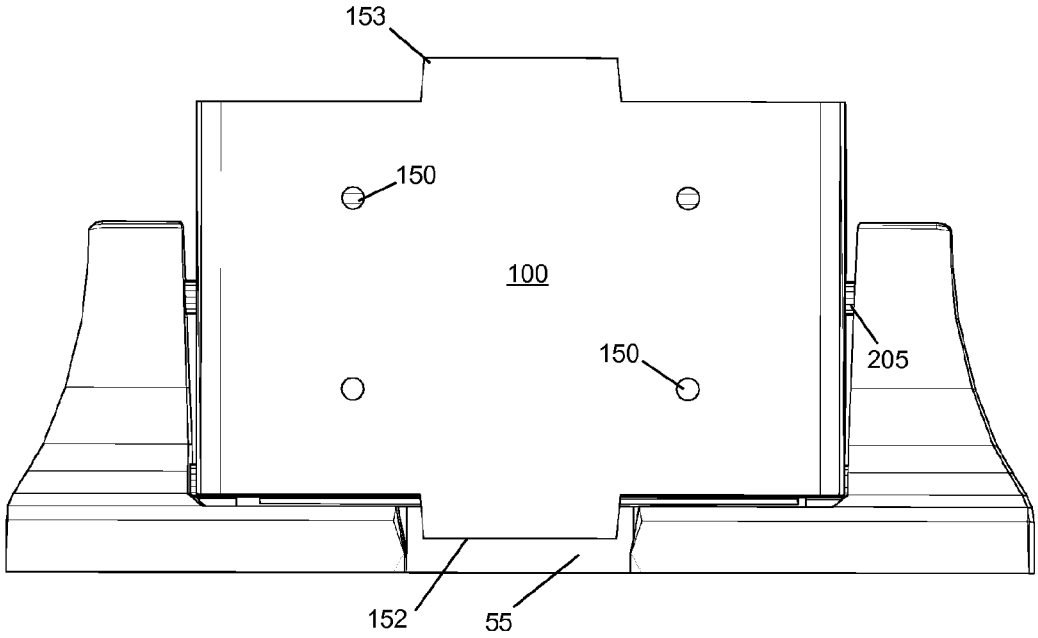
FIG. 23 is a front view of the table leg folding mechanism of FIG. 1 in a storage configuration.
Figure 24:
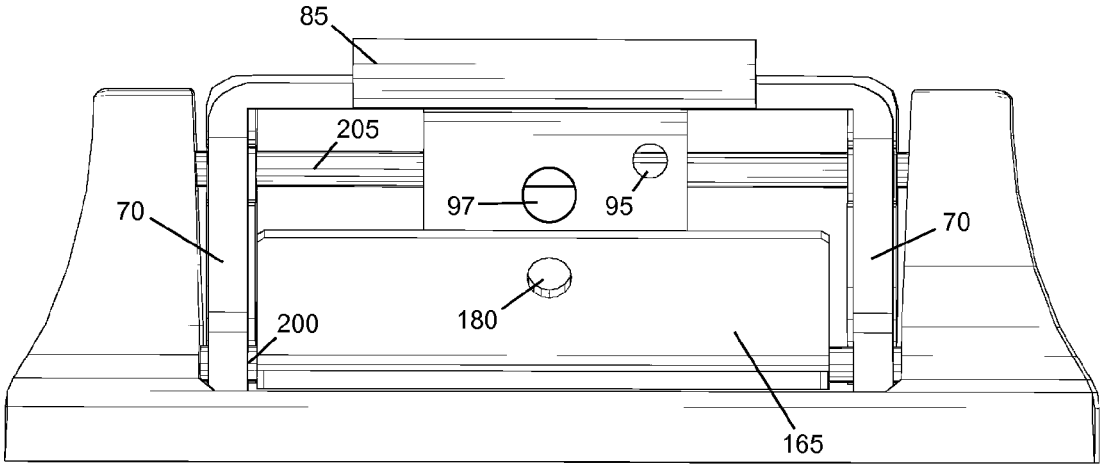
FIG. 24 is a rear view of the table leg folding mechanism of FIG. 1 in a use configuration.
Figure 25:
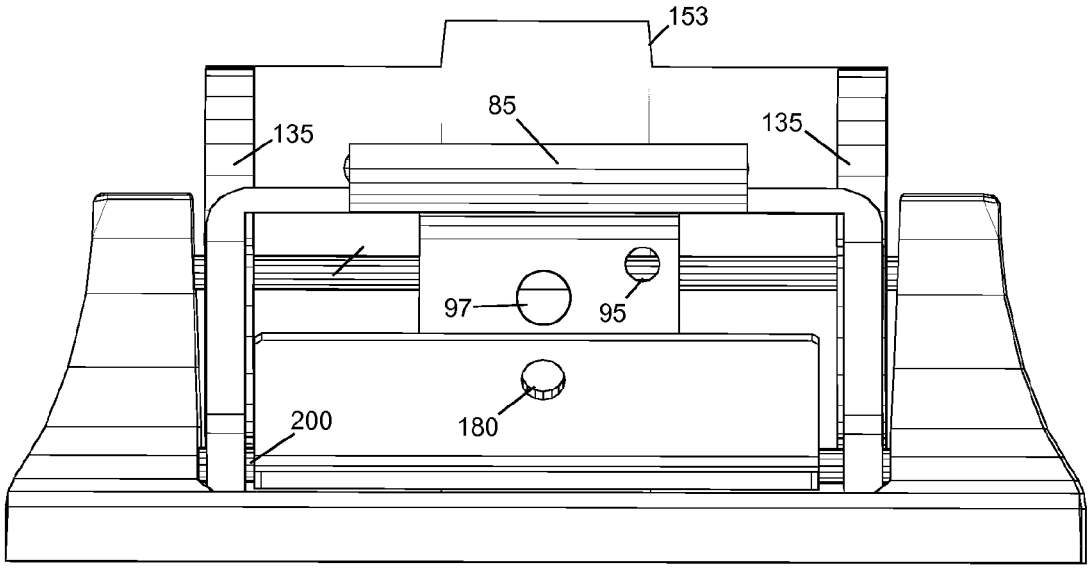
FIG. 25 is a rear view of the table leg folding mechanism of FIG. 1 in a storage configuration.

FIG. 17 illustrates an example of a right circular cylindrical arc 154 having a third radius 155 from a central axis 156 and an arc length 157 that is equal to twice the third radius 155 times Pi times the central angle 158 divided by 360 degrees. In an exemplary embodiment of the invention, the inner and outer radial surfaces of the latching surface of the rotor are substantially defined by and encompass a circular cylindrical arc.

Figure 26:
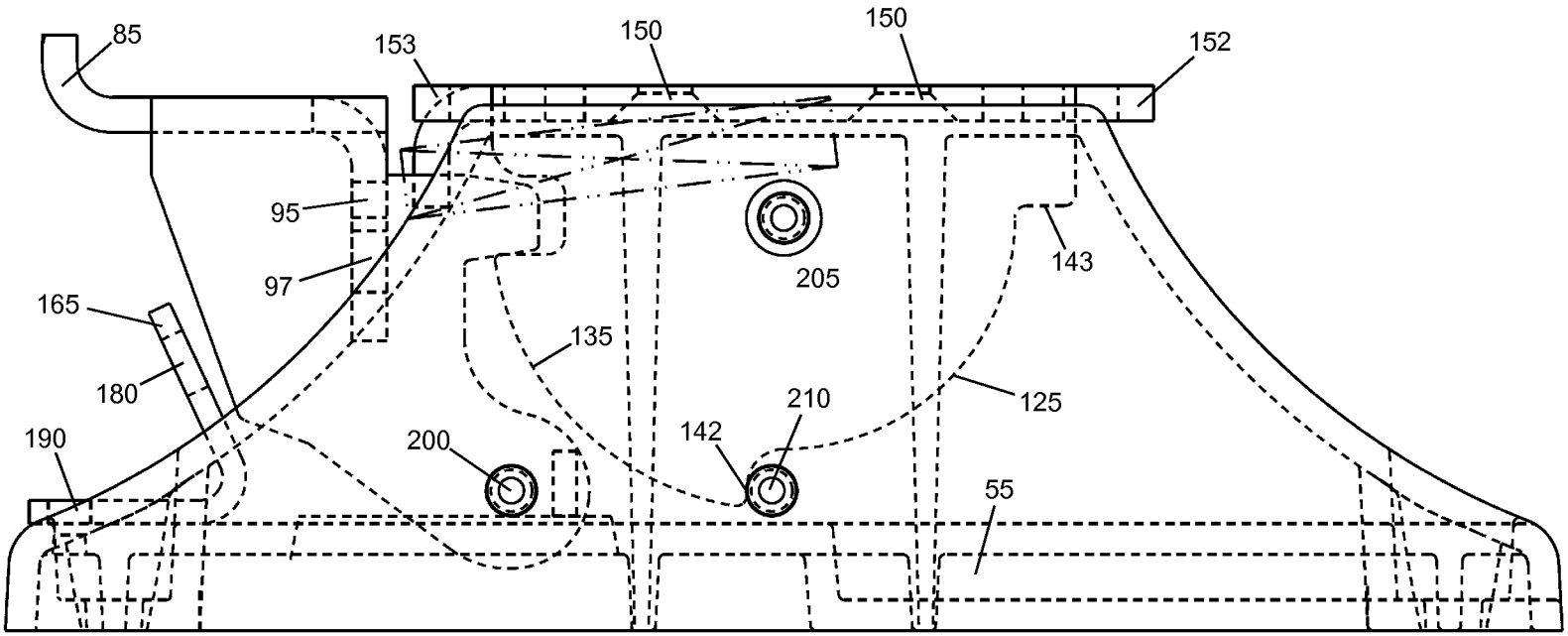
FIG. 26 is a side see through view of the table leg folding mechanism of FIG. 1 in a use configuration.

FIGS. 18-25 show additional views of the latching mechanism in both the storage and use configurations. FIG. 26 shows a side-see through view of the latching mechanism further illustrating the relationships between the latch, the rotor, and the base.

Figure 29:
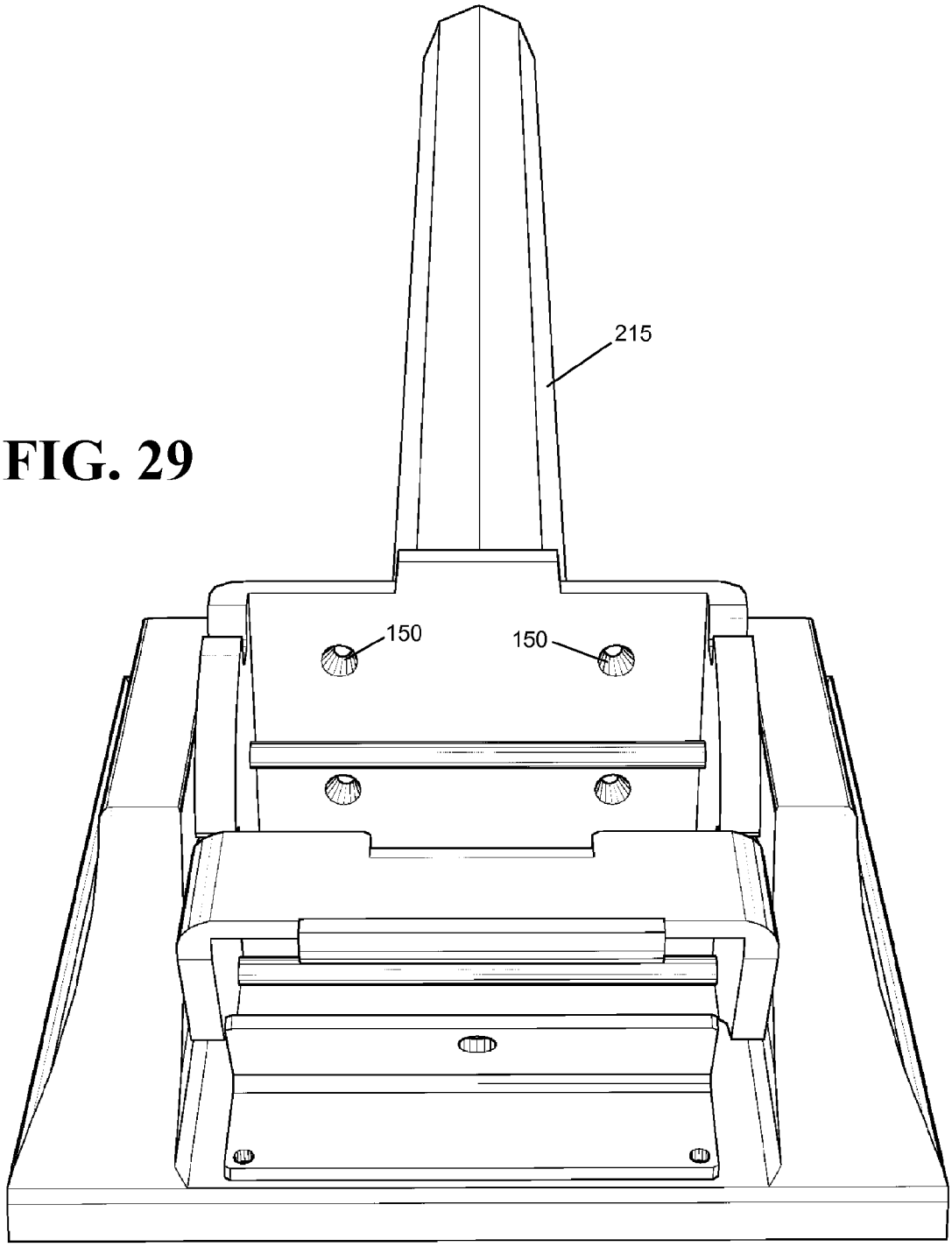
FIG. 29 is a perspective view of the table leg folding mechanism of FIG. 1 in a storage configuration secured to a table leg.

FIGS. 27-29 illustrate a latching mechanism connected to a table leg 215. In the illustrated example, the table leg 215 only connects to a portion of the leg apertures 150. The primary section of the rotor may include more apertures than needed for a single leg in such that various styles of table legs may be connected to a single style of latching mechanism.

Figure 30:
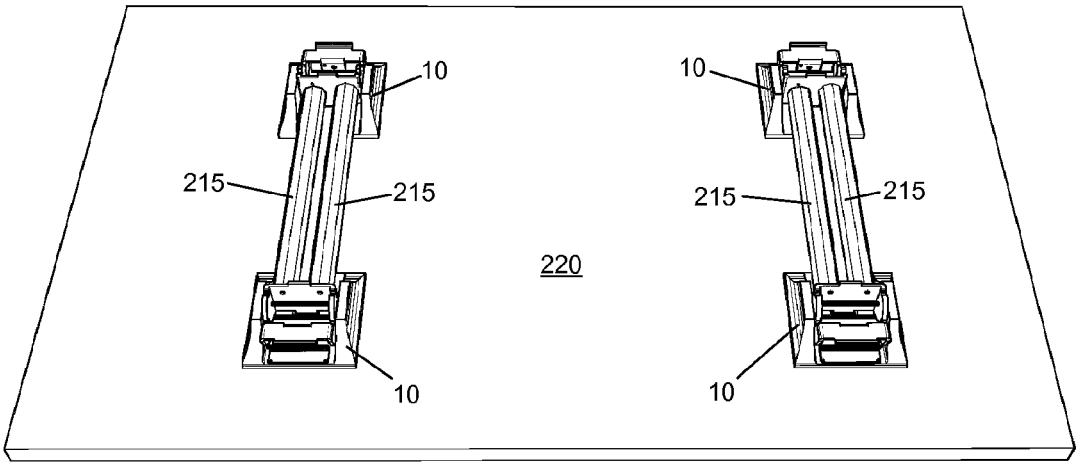
FIG. 30 is a perspective view of a plurality of table leg folding mechanisms of FIG. 1 in a storage configuration, wherein each mechanism of FIG. 1 is secured to both a table leg and a tabletop.
Figure 31:
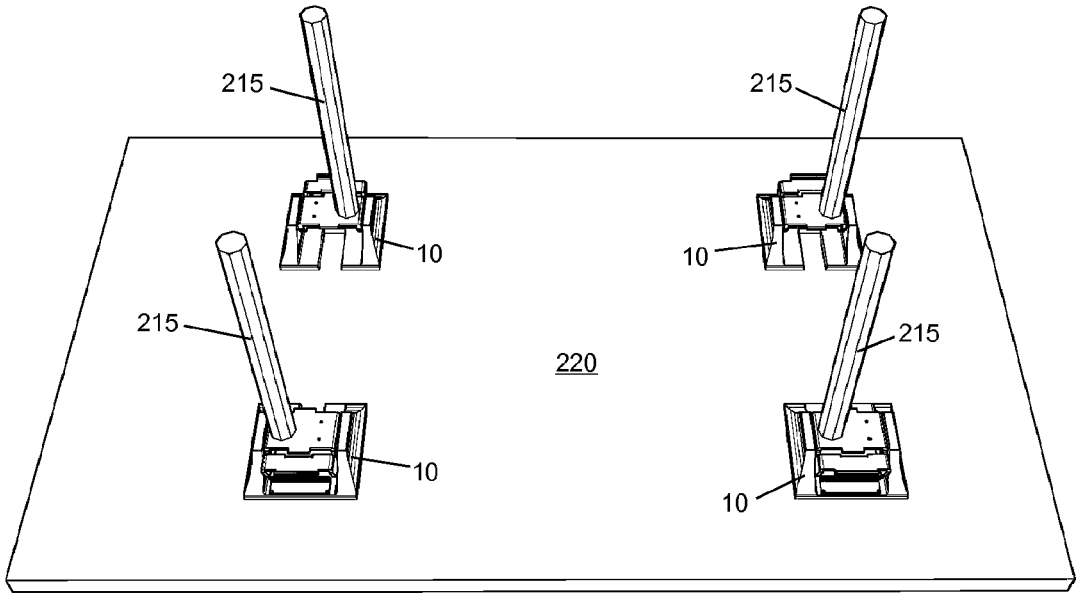
FIG. 31 is a perspective view of a plurality of table leg folding mechanisms of FIG. 1 in a use configuration, wherein each mechanism of FIG. 1 is secured to both a table leg and a tabletop.

FIGS. 30 and 31 illustrate four latching mechanisms 10 of FIG. 1 securing four table legs 215 to a tabletop 220. In the illustrated example, four latching mechanisms are secured to the table top, however fewer or additional latching mechanisms may be used.

FIGS. 32 and 33 illustrate a latching mechanism that is remotely operable via a cable mechanism. A cable 175 passes through both the cable aperture in the cable stand and the cable release aperture 97 in the latch and acts to draw the latch toward the cable stand and away from the rotor.

Figure 34:
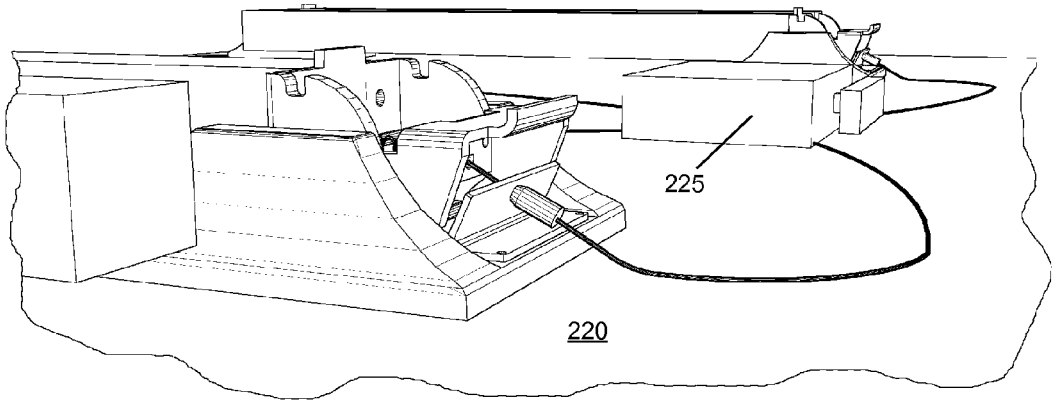
FIG. 34 is a perspective view of a plurality of leg folding mechanisms that each includes a cable release device.
Figure 35:
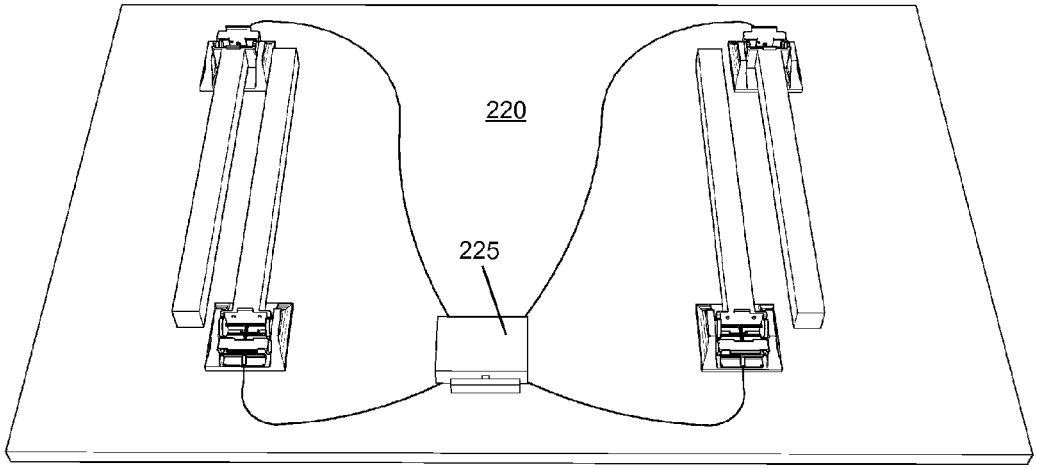
FIG. 35 is a top perspective view of a table secured to a plurality of leg folding mechanisms that each includes a cable release device, wherein all of the cables extend to a central box.

FIGS. 34 and 35 illustrate multiple latching mechanisms on a tabletop 220 that each has a cable mechanism that allows a user to disengage the latch from the rotor without directly contacting the latch. The cable mechanisms are connected to a cable pull 225 that simultaneously pulls multiple cables and allows a user to simultaneously disengage multiple latches from multiple rotors.

The inventor contemplates several alterations and improvements to the disclosed invention. The latching and release mechanisms may further include protective and/or decorative coatings such as paint. Other alterations, variations, and combinations are possible that fall within the scope of the present invention. For example, a spring may be added between the base and the rotor so that the mechanism will automatically transition from a "use" position to a "folded" position when the latch is released from the rotor. Although various embodiments of the present invention have been described, those skilled in the art will recognize more modifications that may be made that would nonetheless fall within the scope of the present invention. Therefore, the present invention should not be limited to the apparatus described. Instead, the scope of the present invention should be consistent with the invention claimed below.

I claim:

1. A tabletop and a leg to support the tabletop in combination with a leg latching mechanism, the combination comprising:

a base rigidly secured to the tabletop, the base having a base catch;

a latch movably secured to the base, the latch having a first catch;

a rotor rotatable between a first configuration and a second configuration rotatably secured to the base,
rigidly secured to the leg,
rotatable about a first axis of rotation oriented parallel to the tabletop,
rotatable between an use position and a storage position, and
having a first latching surface partially encircling the first axis of rotation, the first latching surface including
a first inner surface substantially defined by and encompassing a first circular cylindrical arc with
a first central axis on the first axis of rotation of the rotor,
a first radius from the first central axis, and
a first arc length of a first distance;
a first protrusion surface distant from a second protrusion surface, each protrusion surface radially aligned with the first axis of rotation and extending from the first inner surface; and
a first notch area substantially defined by and complimentary to the first catch of the latch, the first notch area having a first opening of a second distance wherein the second distance is substantially less than the first distance;
wherein in the first configuration
the base catch is contacting the second protrusion surface and the first protrusion surface is contacting the first catch; and
wherein in the second configuration
the first protrusion surface is contacting the base catch.

2. The combination of claim 1 further comprising
the first latching surface including
a first outer surface between the first notch area and the first inner surface, the first outer surface substantially defined by and encompassing
a second circular cylindrical arc with
a second central axis on the first axis of rotation, and
a second radius from the second central axis;
the first protrusion surface extending from the first inner surface to the first outer surface.

3. The combination of claim 2 further comprising:
the base catch located directly between the tabletop and the first axis of rotation, wherein the base catch is located a distance between the first radius and the second radius from the first axis of rotation.

4. The combination of claim 3 further comprising the rotor further including:
a primary section rigidly secured to the leg and
a having a second latching surface partially encircling the first axis of rotation, the second latching surface separated from the first latching surface by the primary section of the rotor, the second latching surface including
a second inner surface substantially defined by and encompassing
a third circular cylindrical arc with
a third central axis on the first axis of rotation of the rotor,
a third radius from the third central axis, and
a third arc length of a third distance;
a second notch area having a second opening of a fourth distance wherein the fourth distance is substantially less than the third distance;
a second outer surface between the second notch area and the second inner surface, the second outer surface substantially defined by and encompassing
a fourth circular cylindrical arc with
a fourth central axis on the first axis of rotation, and
a fourth radius from the fourth central axis.

5. The combination of claim 4 wherein, the fourth radius is equal to the second radius and the third radius is equal to the first radius.

6. The combination of claim 2 further comprising
the base catch located directly between the tabletop and the first axis of rotation, wherein the base catch is located a distance between the first radius and the second radius from the first axis of rotation;
wherein in the first configuration the leg is located proximal to the table top and
the first catch of the latch is adjacent to the first inner surface of the rotor;
wherein in the second configuration the leg extends away from the table top and
the first catch of the latch is interconnected with the first notch area of the rotor.

7. The combination of claim 6
wherein in the first configuration
the base catch contacts the second protrusion surface to inhibit one of clockwise or counterclockwise rotation of the rotor about the first axis of rotation, and
the first catch of the latch contacts the first protrusion surface to inhibit the other of clockwise or counterclockwise rotation of the rotor about the first axis of rotation.

8. The combination of claim 2 wherein
the first circular cylindrical arc has a first central angle of at least 60 degrees and the second circular cylindrical arc has a second central angle of at least 60 degrees.

9. The combination of claim 1 further comprising
the latching mechanism including a cable release mechanism having
a cable pull rigidly secured to the table top,
a cable guide rigidly secured to the base, and
a cable extending from the cable pull through the cable guide to the latch;
wherein actuation of the cable by the cable pull disengages the catch of the latch from the latching surface of the rotor.

10. The combination of claim 1 further comprising
the base including a first wall parallelly oriented to a second wall,
the first and second walls
oriented perpendicular to the table top,
passing through the first axis of rotation, and
flanking the rotor.

11. The combination of claim 10 further comprising
the latch rotatable about a second axis of rotation oriented parallel to the first axis of rotation, the latch further including a spring biasing the catch of the latch into engagement with the latching surface of the rotor; and
the first and second walls
passing through the second axis of rotation, and
flanking the latch.

12. The combination of claim 10 further comprising
the rotor including a sidewall
passing through the first axis of rotation,
oriented parallel to the first and second walls, and
including the latching surface.

13. The combination of claim 1 wherein
the latch, the base, and the rotor each consists of a single piece of metal.

14. The combination of claim 1 wherein
the first circular cylindrical arc has a central angle of at least 30 degrees.

15. The combination of claim 1 wherein
the first latching surface including
a first outer surface between the first notch area and the first inner surface, the first outer surface substantially defined by and encompassing
a second circular cylindrical arc with
a second central axis on the first axis of rotation, and
a second radius from the second central axis
the first circular cylindrical arc has a first central angle of at least 60 degrees
the base catch located between the tabletop and the first axis of rotation, wherein the base catch is located a distance between the first radius and the second radius from the first axis of rotation.

16. The combination of claim 15
the base including a first wall parallelly oriented to a second wall,
the first and second walls
oriented perpendicular to the table top,
passing through the first axis of rotation, and
flanking the rotor;
wherein the first wall includes a first aperture and the second wall includes a second aperture; and
the base catch is a rod
extending from the first wall to the second wall,
secured in the first aperture of the first wall, and
secured in the second aperture of the second wall.

17. The combination of claim 1 further comprising
the latch rotatable about a second axis of rotation oriented parallel to the first axis of rotation, the latch further including a spring biasing the catch of the latch into engagement with the latching surface of the rotor.

18. A tabletop and a leg to support the tabletop in combination with a leg latching mechanism, the combination comprising:
a base secured to the tabletop, the base including a base catch;
a latch
secured to the base, the latch having a first catch;
a rotor
rotatably secured to the base,
rigidly secured to the leg,
rotatable about a first axis of rotation,
rotatable between a first configuration and a second configuration, and
having a first latching surface partially encircling the first axis of rotation, the first latching surface including
a first protrusion distant from a second protrusion, each protrusion radially extending away from the axis of rotation,
a first notch area substantially defined by and complimentary to the first catch of the latch;
wherein in the first configuration, the base catch contacting the second protrusion to inhibit only one of clockwise or counterclockwise rotation of the rotor about the first axis of rotation, and the first catch of the latch contacting the first protrusion of the latching surface to inhibit the other of clockwise or counterclockwise rotation of the rotor about the first axis of rotation; and
wherein in the second configuration, the first catch of the latch secured in the first notch area and the batch catch contacting the first protrusion.

19. The combination of claim 18 further comprising
the latching surface including
a first inner surface extending from the first protrusion to the second protrusion, the first inner surface substantially defined by and encompassing a first circular cylindrical arc with
a first central axis on the first axis of rotation of the rotor,
a first radius from the first central axis, and
a first arc length of a first distance; and
in both the first configuration and the second configuration, the base catch is located adjacent to the first inner surface.

20. The combination of claim 18 further comprising
the latch rotatabale about a second axis of rotation oriented parallel to the first axis of rotation, the latch further including a spring biasing the catch of the latch into engagement with the latching surface of the rotor.

* * * * *